US012391885B2

(12) United States Patent
Coustham et al.

(10) Patent No.: US 12,391,885 B2
(45) Date of Patent: Aug. 19, 2025

(54) METHOD FOR PURIFYING A PYROLYSIS OIL IN ORDER TO UPGRADE IT BY STEAM-CRACKING

(71) Applicant: TotalEnergies OneTech, Courbevoie (FR)

(72) Inventors: Thomas Coustham, Ablon (FR); Marfiza Victoria Berrio Navarro, Le Havre (FR); Hélène Coulombeau-Leroy, Montivilliers (FR); Sébastien Leplat, Honfleur (FR); Quentin Lesueur, Grenoble (FR); Didrik Haudebourg, Le Havre (FR)

(73) Assignee: TotalEnergies OneTech, Courbevoie (FR)

( * ) Notice: Subject to any disclaimer, the term of this patent is extended or adjusted under 35 U.S.C. 154(b) by 80 days.

(21) Appl. No.: 18/273,928

(22) PCT Filed: Jan. 24, 2022

(86) PCT No.: PCT/FR2022/050125

§ 371 (c)(1),
(2) Date: Jul. 24, 2023

(87) PCT Pub. No.: WO2022/162298

PCT Pub. Date: Aug. 4, 2022

(65) Prior Publication Data

US 2024/0076558 A1 Mar. 7, 2024

(30) Foreign Application Priority Data

Jan. 29, 2021 (FR) ..... 2100907
Jun. 29, 2021 (FR) ..... 2106955

(51) Int. Cl.

| | |
|---|---|
| ***C10G 21/16*** | (2006.01) |
| ***C10G 1/00*** | (2006.01) |
| ***C10G 1/10*** | (2006.01) |
| ***C10G 21/12*** | (2006.01) |
| ***C10G 21/20*** | (2006.01) |
| ***C10G 55/04*** | (2006.01) |

(52) U.S. Cl.

CPC ..... *C10G 21/16* (2013.01); *C10G 1/002* (2013.01); *C10G 1/10* (2013.01); *C10G 21/12* (2013.01); *C10G 21/20* (2013.01); *C10G 55/04* (2013.01); *C10G 2300/1003* (2013.01); *C10G 2300/202* (2013.01); *C10G 2300/44* (2013.01)

(58) Field of Classification Search

CPC ..... C10G 1/002; C10G 1/10; C10G 21/06; C10G 21/12; C10G 21/16; C10G 21/20; C10G 2300/1003; C10G 2300/1011; C10G 2300/202; C10G 2300/44; C10G 3/40; C10G 55/04; C10G 9/36

See application file for complete search history.

(56) References Cited

FOREIGN PATENT DOCUMENTS

AU 2014 236 246 A1 11/2015
WO WO-2020178599 A1 * 9/2020 ..... C10G 1/002

OTHER PUBLICATIONS

International Search Report for PCT/FR2022/050125 dated May 17, 2022 (PCT/ISA/210).

* cited by examiner

*Primary Examiner* — Ellen M McAvoy
*Assistant Examiner* — Chantel Graham
(74) *Attorney, Agent, or Firm* — Sughrue Mion, PLLC

(57) ABSTRACT

The invention relates to a method for purifying a pyrolysis oil originating from the pyrolysis of waste including plastics by liquid/liquid extraction. This extraction is performed by means of a polar solvent that is immiscible with pyrolysis oil, for which a recovery rate is obtained greater than or equal to 0.95, this recovery rate being defined as the ratio of the extract volume over the initial volume of solvent, this extract being a phase containing the solvent which is immiscible with pyrolysis oil, recovered after agitation then decantation of a mixture of one part by volume of solvent with twenty-five parts by volume of pyrolysis oil at atmospheric pressure and at a temperature of 20° C.

14 Claims, No Drawings

METHOD FOR PURIFYING A PYROLYSIS OIL IN ORDER TO UPGRADE IT BY STEAM-CRACKING

CROSS REFERENCE TO RELATED APPLICATIONS

This application is a National Stage of International Application No. PCT/FR2022/050125 filed Jan. 24, 2022, claiming priority based on French Patent Application No. 2100907 filed Jan. 29, 2021, and French Patent Application No. 2106955 filed Jun. 29, 2021.

FIELD OF THE INVENTION

The invention relates to the upgrading of oils from the pyrolysis of waste, in particular as a feedstock for a steam-cracking method. The method according to the invention makes it possible in particular to purify pyrolysis oil from plastic waste of all kinds, whatever its origin. This plastic waste may contain other types of waste in varying proportions, such as lignocellulosic biomass and/or elastomers.

PRIOR ART

Pyrolysis is an endothermic decomposition in a reducing atmosphere (oxygen-free or oxygen-poor atmosphere or atmosphere of inert gases) under the effect of heat (from 300° C.). This method breaks down solid organic matter into three phases: solid (pyrolysis coke or char), liquid (constituted by heavy condensables, pyrolysis oils or tars or light, $H_2O$) and gas (CO, $H_2$, $CO_2$, olefins and short paraffins). This solid organic matter can include plastics, biomass, agricultural waste, household waste. As the volume of waste increases, pyrolysis makes it possible to contemplate upgrading this waste by converting it into liquid products that can then be treated to produce high added-value products.

However, the liquid products of pyrolysis, also known as pyrolysis oils, can contain high levels of undesirable compounds, particularly when used as feedstock for a steam-cracking treatment. These undesirable compounds (or contaminants) include heteroatoms, in particular oxygen, nitrogen and sulphur, but also halogens and transition metals. Other undesirable compounds include unsaturated hydrocarbon compounds, in particular aromatics and dienes.

Document WO2020/212315 describes a method for recovering aliphatic hydrocarbons from a liquid product of the pyrolysis of plastic waste, in particular a mixture of plastics. This liquid product is subjected to a solvent extraction to obtain a raffinate with a reduced content of aromatic hydrocarbons and/or polar compounds in comparison with the liquid product. These polar compounds are organic compounds containing heteroatoms (N, S, O) or salts that may include a cation, such as an ammonium cation, an alkali metal cation, an alkaline earth element cation, a transition metal cation, and an anion, such as a carboxylate, sulphate, phosphate or halide ion. The raffinate resulting from the liquid-liquid extraction then undergoes a further resource-intensive water extraction in order to remove the solvent present in the raffinate.

Document WO2020/178599A1 describes a method for upgrading a pyrolysis oil originating from the pyrolysis of plastic or rubber, or a combination thereof. The pyrolysis oil is treated with an extraction solution comprising a polar organic solvent to provide a mixture comprising an extract and a raffinate. The raffinate obtained by this extraction method is a pyrolysis oil with a reduced content of undesirable compounds such as solid residues, olefins and compounds containing heteroatoms (sulphur, nitrogen and halogen). Oxygenated compounds are considered desirable compounds. The upgrading solution can also include a hydrocarbon fluid (alkanes or alkenes, or a mixture of the two) to promote separation of the raffinate from the extract.

These documents do not describe the treatment of pyrolysis oils from the pyrolysis of plastic waste mixed with other types of waste.

SUMMARY OF THE INVENTION

The purpose of the invention is to provide a method for purifying a pyrolysis oil which makes it possible to significantly reduce the amount of compounds comprising heteroatoms, and more particularly oxygen, nitrogen, sulphur, metals, in particular transition metals, and halides initially contained in the pyrolysis oil. The invention can also make it possible to reduce the amount of unsaturated hydrocarbon compounds initially contained in the pyrolysis oil, in particular aromatic compounds and diolefins.

A first object of the invention relates to a method for purifying a pyrolysis oil originating from the pyrolysis of waste containing plastics, comprising the following steps:

- providing a pyrolysis oil containing saturated and unsaturated hydrocarbon compounds and polar compounds comprising at least one heteroatom chosen from oxygen, sulphur, nitrogen, a transition metal, an alkali metal, an alkaline earth metal and a halogen,
- contacting the pyrolysis oil with a polar extraction solvent which is immiscible with the pyrolysis oil,
- recovering an extract and an raffinate which are immiscible with each other, the extract containing the extraction solvent and at least one part of the polar compounds, and optionally at least one part of the unsaturated hydrocarbon compounds, initially contained in the pyrolysis oil, the raffinate containing a treated pyrolysis oil with a reduced content of polar compounds and optionally of unsaturated hydrocarbon compounds,
- wherein the polar extraction solvent immiscible with the pyrolysis oil is a solvent for which a recovery rate greater than or equal to 0.95 is obtained, this recovery rate being defined as the ratio of the volume of an extract to the volume of initial solvent, and this extract is a phase containing the solvent, immiscible with the pyrolysis oil, recovered after agitation and then decanting a mixture of one part by volume of solvent with twenty-five parts by volume of the pyrolysis oil at atmospheric pressure and at a temperature of 20° C.

The raffinate obtained by the method according to the invention is thus free or virtually free of solvent, so that it does not need to undergo another extraction step before use.

The method according to the invention makes it possible to extract at least 20 m/m %, at least 30 m/m %, even at least 40 m/m % or at least 50 m/m % of all the polar compounds initially contained in the pyrolysis oil, in particular several polar compounds, in particular those containing oxygen, sulphur, nitrogen, halogens, in particular chlorine, fluorine and bromine, and metals, in particular transition metals, in particular iron. The method according to the invention can also be used to extract at least 10 m/m % of unsaturated hydrocarbon compounds.

Another object of the invention is a steam-cracking method comprising a step of steam-cracking a pyrolysis oil raffinate recovered during the implementation of the method according to the invention.

This pyrolysis oil raffinate can be pure or diluted, in particular introduced as a mixture with a typical steam-cracking feedstock.

DETAILED DESCRIPTION OF THE INVENTION

When describing the invention, the terms used are to be construed in accordance with the following definitions, unless the context requires otherwise.

The terms "comprising", "comprises" as used herein are synonymous with "including", "includes" or "containing", "contains", and are inclusive or non-inclusive and do not exclude additional members, elements or method steps not described. It will be appreciated that the terms "comprising", "comprises" and "comprised of" as used herein include the terms "consists of", "consists of" and "is composed of".

The description of numerical ranges by limit values includes all integers and, where appropriate, fractions included in that range (for example, 1 to 5 may include 1, 2, 3, 4, 5 when referring, for example, to a number of elements, and may also include 1.5; 2; 2.75 and 3.80, when referring, for example, to measurements). The description of numerical ranges also includes the limit values themselves (e.g. 1.0 to 5.0 includes both 1.0 and 5.0). Any numerical range mentioned in this document is intended to include all sub-ranges included therein.

All references cited in this specification are incorporated by reference in their entirety. In particular, the teachings of all references specifically referred to in this specification are incorporated by reference.

The characteristics and embodiments of the present invention are set forth below. Each characteristic and embodiment of the invention so defined may be combined with any other characteristic and/or embodiment, unless otherwise stated. In particular, any characteristic indicated as preferred or advantageous may be combined with any other characteristic or embodiment indicated as preferred or advantageous.

Pyrolysis Oil

The pyrolysis oil treated in the present invention (and provided in the first step) is a pyrolysis oil originating from the pyrolysis of waste comprising plastics.

Advantageously, the pyrolysis oil provided may be a liquid organic phase resulting from the pyrolysis of waste selected from plastics and at least one other waste material such as biomass, for example selected from lignocellulosic biomass, paper and cardboard, and/or one or several elastomers.

This liquid organic phase may be a mixture of liquid organic phases, each organic phase coming from the pyrolysis of one of the aforementioned waste products, or may be a single liquid organic phase resulting from the pyrolysis of one of the aforementioned waste products or from a mixture of two or more of the aforementioned waste products. In other words, the pyrolysis oil treated in the present invention may be a single pyrolysis oil or a mixture of several pyrolysis oils.

Typically, the liquid organic phase results from pyrolysis of the aforementioned waste material(s) at a temperature of 300 to 1000° C. or 400 to 700° C., this pyrolysis being, for example, fast pyrolysis, flash pyrolysis, catalytic pyrolysis or hydropyrolysis.

Plastics can be any type of new or used plastic, included in household (post-consumer) or industrial waste. Plastics are materials consisting of polymers and, optionally, auxiliary components such as plasticisers, fillers, colouring agents, catalysts, flame retardants, stabilisers, etc. These polymers can be chosen from thermosetting polymers and thermoplastic polymers. Typically, these are polymers or copolymers based on polyolefins, vinyl polymers, styrene polymers, acrylic polymers, polyamides, polyesters, polyurethanes, polycarbonates, polyethers, epoxy polymers, polyacetals, polyimides and silicones. In particular, the present invention makes it possible to treat an oil from the pyrolysis of waste comprising mixtures of two or more of these polymers or copolymers, or to treat mixtures of two or more pyrolysis oils, each oil resulting from the pyrolysis of waste comprising one or more of these polymers or copolymers.

Typical polymers found in plastics are polystyrene (PS), polyethylene terephthalate (PET), polypropylene (PP), acrylonitrile-butadiene-styrene (ABS), polybutylene, polybutylene terephthalate (PBT), halogenated (Cl, F) or not halogenated high and low density polyethylene (PE), polyvinyl chloride (PVC), polyvinylidene chloride (PVDC), etc., or polymers obtained by polycondensation such as polyamides, polyesters, polyesteramides, etc.

Elastomers are linear or branched polymers transformed by vulcanisation into a three-dimensional, weakly cross-linked, infusible and insoluble network. They include natural and synthetic rubbers. They may be part of tyre-type waste or any other household or industrial waste containing elastomers, natural and/or synthetic rubber, whether or not mixed with other components, such as plastics, plasticisers, fillers, vulcanising agents, vulcanisation accelerators, additives, etc. Examples of elastomeric polymers include ethylene-propylene copolymers, ethylene-propylene-diene terpolymer (EPDM), polyisoprene (natural or synthetic), polybutadiene, styrene-butadiene copolymers, isobutene-based polymers, chlorinated or brominated isobutylene isoprene copolymers, acrylonitrile butadiene copolymers (NBR) and polychloroprenes (CR), polyurethanes, silicone elastomers, etc.

Table 1 below lists the main characteristics of plastic pyrolysis oils.

TABLE 1

| | | MIN | MAX |
|---|---|---|---|
| Density at 15° C. | kg/m$^3$ | 750 | 900 |
| Kinematic viscosity at 40° C. | mm$^2$/s | 1.0 | 3.0 |
| Kinematic viscosity at 15° C. | mm$^2$/s | 2.0 | 8.0 |
| TAN | Mg KOH/g | <0.1 | 30 |
| Water content | % mass | <0.15 | 0.10 |
| Distillation TBP | | | |
| dist. 5% (±4°) | ° C. | 30 | 160 |
| dist. 50% (±8°) | ° C. | 210 | 320 |
| dist. 95% (±10°) | ° C. | 330 | 530 |
| Composition PONA | | | |
| Paraffins (GC): | m/m % | 30 | 55 |
| Olefins (NMR or GC): | m/m % | 10 (NMR) | 50 (NMR) |
| Cyclo-Paraffins (GC): | m/m % | 10 | 18 |
| Aromatics (GC): | m/m % | 5 | 12 |
| Bromine value | g Br/100 g | 20 | 60 |
| Maleic Anhydride Value (**) (ASTM UOP326) | mg of maleic anhydride/1 g | 1 | 20 |

TABLE 1-continued

| | | MIN | MAX |
|---|---|---|---|
| CHONS | | | |
| C | m/m % | 80 | 90 |
| H | m/m % | 10 | 18 |
| 0 | m/m % | 0 | 8 |
| N | ppm | 250 | 3800 |
| S | ppm | 35 | 850 |
| Metals + P + Se | ICP-AES | | |
| Al | ppm | <0.25 | 15 |
| Ca | ppm | <0.25 | 18 |
| Ce | ppm | <2 | <5.00 |
| Co | ppm | <0.25 | <3.00 |
| Cr | ppm | <0.25 | <3.00 |
| Cu | ppm | <0.25 | <3.00 |
| Fe | ppm | 1 | 25 |
| K | ppm | <1 | <4.0 |
| Na | ppm | 2 | 80 |
| Ni | ppm | <0.25 | <3.00 |
| P | ppm | 1 | 66 |
| Sb | ppm | <0.25 | 4.00 |
| Se | ppm | <0.5 | <4.0 |
| Si | ppm | 20 | 700 |
| Zn | ppm | nd | nd |
| Total | ppm | 34 | 900 |
| | ICP-MS | | |
| As | ppb | | 20 |
| Hg | ppb | | <15 |
| Halogens | | | |
| Cl total | ppm | 50 | 6000 |
| Br total | ppm | | 10 |
| F total | ppm | 1.5 | 10 |
| Potential gum (*) | (mg/100 mL) | 5 | 10000 |

GC: gas chromatography
ICP-MS: inductively coupled plasma mass spectrometry
ICP-AES: inductively coupled plasma atomic emission spectrometry
(*) measured according to ASTM D873.
(**) also known as MAV (Maleic Anhydride Value)

Biomass can be defined as any organic plant or animal product.

Biomass thus comprises:

- biomass produced from surplus agricultural land not used for human or animal consumption: dedicated crops, known as energy crops;
- biomass produced by deforestation (forest maintenance) or clearing of agricultural land;
- agricultural residues from cereal crops, vines, orchards, olive groves, fruit and vegetables, agri-food residues, etc.;
- forestry residues from forestry and wood processing;
- agricultural waste from livestock farming (solid manure, liquid manure, litter, bird droppings, etc.);
- organic waste from households (paper, cardboard, green waste, etc.);
- ordinary industrial organic waste (paper, cardboard, wood, putrescible waste, etc.)

The pyrolysis oil treated by the invention may come from the pyrolysis of one or several of the aforementioned biomasses, residues and organic waste.

Advantageously, the pyrolysis oil treated by the invention may result from the pyrolysis of a lignocellulosic biomass, consisting essentially of cellulose, hemicellulose and lignin, for example of the wood (deciduous, coniferous), straw, energy crops (short-rotation coppice (SRC), very short-rotation coppice (VSRC), miscanthus, switchgrass, sorghum, etc.) and forest or agricultural biomass residues such as bark, shavings, sawdust and bagasse. Biomass pyrolysis oils are produced by depolymerisation and fragmentation of the constituent elements of biomass (holocelluloses (cellulose, hemicellulose), lignin), typically through a rapid increase (<2 seconds) in temperature to 450° C.-550° C. and rapid quenching of the intermediate degradation products. Biomass pyrolysis oils consist of water (typically 10 to 35 m/m %) and a complex mixture of oxygenated compounds. Their elemental composition is close to that of the starting biomass, in particular with a high oxygen content (40 to 60 m/m %).

Table 2 below lists the main characteristics of lignocellulosic biomass pyrolysis oils.

TABLE 2

| | | MIN | MAX |
|---|---|---|---|
| Density at 15° C. | kg/m$^3$ | 1050 | 1350 |
| Dynamic viscosity at 25° C. | mPa · s | 50 | 300 |
| Dynamic viscosity at 50° C. | mPa · s | 15 | 50 |
| TAN | Mg KOH/g | 50.0 | 300.0 |
| Water content (Karl-Fischer) | mass % | 10.00 | 35.00 |
| Ash content (TGA) | mass % | 0.1 | 2 |
| CHO analysis | | | |
| C | mass % | 35.0 | 60.0 |
| H | mass % | 4.0 | 8.0 |
| 0 | mass % | 30.0 | 60.0 |
| Metals + P | ICP-AES | | |
| Al | ppm | 0 | 10 |
| Ca | ppm | 2 | 50 |
| Cu | ppm | 1 | 10 |
| Fe | ppm | 2 | 30 |
| K | ppm | 2 | 15 |
| Mg | ppm | 1 | 10 |
| Na | ppm | 0 | 10 |
| Mn | ppm | 0 | 10 |
| Ni | ppm | 0 | 5 |
| P | ppm | 0 | 7 |
| Si | ppm | 0 | 7 |
| Zn | ppm | 0 | 5 |
| Total inorganic elements | ppm | 40 | 80 |

The pyrolysis oil treated by the invention can also result from the pyrolysis of paper and/or cardboard.

Advantageously, the pyrolysis oil treated in the method according to the invention may be a liquid organic phase resulting from the pyrolysis of waste comprising 50 m/m % or more plastics, optionally from 50 m/m % to 99 m/m % plastics, optionally in admixture with biomass, elastomer or mixtures thereof. This liquid organic phase may come from the pyrolysis of very different plastics, in other words from a mixture of two or more of the aforementioned polymers or copolymers.

Advantageously, the pyrolysis oil can be a liquid organic phase resulting from the pyrolysis of waste, this waste comprising plastics, in particular in the proportions indicated above, and at least 1 m/m % of at least one other waste material other than a plastic.

This other waste may be chosen from an elastomer and biomass, in particular one or several biomasses chosen from lignocellulosic biomass, paper and cardboard. In other words, the treated waste may comprise at least 1 m/m % of one or more of these biomass and/or elastomer type waste materials, optionally from 1 to 50 m/m %, from 2 to 30 m/m % or in a range defined by any two of these limits. Preferably, the waste material(s) added to the plastics is biomass, or the biomass represents at least 50 m/m %, 60 m/m % or 80 m/m %, preferably at least 90 m/m % of the waste material(s) added.

Alternatively, the pyrolysis oil provided may be a mixture of at least two liquid organic phases resulting from the pyrolysis of waste. It may then comprise 50 m/m % or more, optionally from 50 m/m % to 99 m %, of at least one liquid organic phase resulting from the pyrolysis of plastics, in particular of all kinds and/or origins. The pyrolysed plastics may thus be a mixture of two or more of the aforementioned polymers or copolymers.

The pyrolysis oil provided may also be a mixture of at least two liquid organic phases resulting from the pyrolysis of waste materials, including at least one organic phase resulting from the pyrolysis of plastics, in particular in the proportions indicated above, and at least one organic phase resulting from the pyrolysis of at least one other waste material other than a plastic. This other waste material may be chosen from an elastomer and biomass, in particular one or several biomasses, chosen in particular from lignocellulosic biomass, paper and cardboard. The pyrolysis oil provided may then comprise at least 1 m/m % of an organic phase resulting from the pyrolysis of one or several of these other waste materials, optionally from 1 to 50 m/m %, from 2 to 30 m/m % or in an interval defined by any two of these limits. Preferably, the organic phase or phases resulting from the pyrolysis of at least one other waste material are organic phases resulting from the pyrolysis of biomass, or comprise at least 50 m/m %, 60 m/m % or 80 m/m %, preferably at least 90 m/m % of one or more organic phases resulting from the pyrolysis of biomass.

Generally speaking, a pyrolysis oil may comprise aliphatic hydrocarbons with a boiling point of 30 to 600° C., in particular aliphatic hydrocarbons comprising cyclic, linear or branched carbon chains containing from 4 to 50, or even from 4 to 150, carbon atoms. These aliphatic hydrocarbons may include paraffins and olefins, in particular diolefins, in variable proportions depending on the nature of the pyrolysed waste and the type of pyrolysis process applied. The pyrolysis oil may also comprise aromatic hydrocarbons.

Pyrolysis oil may include solids, typically solid pyrolysis residues ("char") entrained during the pyrolysis process and/or gums formed from gum precursors present in the pyrolysis oil. The amount of solids in a pyrolysis oil can be reduced by one or several solid-liquid separations, for example by filtration or any other suitable technique.

Before treatment by the method according to the invention, the organic phase or phases resulting from the pyrolysis of one or several of the above-mentioned waste materials may optionally be pre-treated, in particular to reduce their solids and/or water content. By way of example, the solids content of the pyrolysis oil provided may be at most 2 m/m %.

The pyrolysis oil treated by the method according to the invention comprises polar compounds and possibly undesirable unsaturated compounds, in particular for subsequent use of the pyrolysis oil as a steam cracker feedstock.

Unsaturated compounds can be aromatic compounds and diolefins that are precursors to gums. Their presence can lead to instability of the pyrolysis oil over time, with for example variations in viscosity and volatility, potential phase separation and formation of gums. In addition, the presence of gums leads to clogging problems in facilities.

Polar compounds comprising heteroatoms can be organic salts, inorganic salts or organic compounds comprising heteroatoms.

The salts can comprise a cation chosen from an ammonium ion, an alkali metal cation, a transition metal cation or an alkaline earth metal cation, and an anion cation chosen from a carboxylate ion, a sulphate ion, a phosphate ion or a halide.

Organic compounds comprising heteroatoms can include amines, amides, nitriles, esters, ethers, acids, aldehydes, ketones and alcohols. Organic compounds comprising heteroatoms can be aliphatic or aromatic.

Typically, amines, amides, nitriles, esters, ethers, acids, halogenated compounds and silicones are present when the waste treated is plastics. Examples of monocyclic aromatic compounds are terephthalic acid or benzoic acid and an example of polycyclic compounds is polyethylene terephthalate oligomer. Typically, acids, aldehydes (including hydroxyaldehydes), ketones (including hydroxyketones) and alcohols (phenols, methanol, ethanol) are present when the waste treated is biomass, in particular lignocellulosic biomass.

Extraction Solvent

The extraction solvent is a polar solvent and may have a density greater or less than the density of the pyrolysis oil treated.

In particular, the density of the extraction solvent may be 3 to 50% higher or lower than that of the pyrolysis oil.

The extraction solvent is furthermore a solvent that is immiscible in the pyrolysis oil to be purified.

In the present invention, the extraction solvent (or a mixture of solvents where applicable) is considered to be immiscible when its recovery rate is greater than or equal to 0.95. This recovery rate is defined as the ratio of the volume of extract to the volume of initial solvent, this extract being a phase containing the solvent, immiscible with the pyrolysis oil, recovered after agitation and then decanting a mixture of one part by volume of solvent with twenty-five parts by volume of the pyrolysis oil to be purified, at atmospheric pressure and at a temperature of 20° C.

In particular, this recovery rate could be determined by the following procedure:

- Introducing 50 mL of pyrolysis oil into a flat-bottomed flask with a volume of 100 mL, using a pipette with a precision of +/−0.5 mL,
- Introducing 2 mL of solvent into the flask using a pipette with a precision of +/−0.1 mL,
- Introducing a bar magnet and close the flask with a polypropylene stopper,
- Agitating the mixture on a mechanical agitation plate at 500 rpm for 5 minutes,
- At the end of the 5 minutes, stopping agitation and removing the bar magnet using a magnetised rod,
- Transferring the contents of the flask into a volumetric tube accurate to +/−0.05 mL for a volume of 2 mL or less and accurate to +/−0.1 mL for a volume of more than 2 mL. Waiting for complete demixing by decantation and measuring the volume of the 2 phases using the graduations. Complete demixing is considered to have been achieved when the volumes of the two phases no longer vary.

The polar solvent may contain one or several heteroatoms, in particular selected from oxygen, sulphur and nitrogen, preferably oxygen.

The polar solvent which is immiscible with the pyrolysis oil to be purified may be selected from:

- water with an acidic, basic or neutral pH. An acidic pH can be obtained by adding one or several organic or inorganic acids. Examples of organic acids that can be used include citric acid ($C_6H_8O_7$), formic acid ($CH_2O_2$), acetic acid ($CH_3COOH$) and sulphamic acid ($H_3NS0_3$). Examples of inorganic acids are hydrochloric acid (HCl), nitric acid ($HNO_3$), sulphuric acid ($H_2SO_4$) and phosphoric acid ($H_3PO_4$). A basic pH can be obtained by adding alkali and alkaline-earth metal oxides, alkali and alkaline-earth hydroxides (e.g. NaOH, KOH, $Ca(OH)_2$) and amines (e.g. triethylamine, ethylenediamine, ammonia).

glycol ethers, including in particular polyethylene glycol of the chemical formula $HO—(CH_2—CH_2—O)_n—H$ with a mass-average molar mass of 90 to 800 g/mol, for example diethylene glycol and tetraethylene glycol, polypropylene glycol of the chemical formula $H[OCH(CH_3)CH_2]_nOH$ with a mass-average molar mass of 130 to 800 g/mol, for example dipropylene glycol and tetrapropylene glycol, dialkyl formamides, in which the alkyl group may comprise from 1 to 8 or from 1 to 3 carbon atoms, in particular dimethyl formamide (DMF), dialkyl sulphoxides, in which the alkyl group may comprise from 1 to 8 or from 1 to 3 carbon atoms, in particular dimethyl sulphoxide (DMSO) and sulpholane, compounds comprising a furan ring, for example furfural, 5-(hydroxymethyl)furfural, furfuryl alcohol (2-furanemethanol), cyclic carbonate esters, in particular comprising from 3 to 8 or from 3 to 4 carbon atoms, in particular propylene carbonate and ethylene carbonate.

One or several of the aforementioned solvents may be used. However, advantageously, only one of the aforementioned solvents can be used as extraction solvent provided that it is immiscible with the oil to be purified.

Preferably, the extraction solvent can be a glycol ether, in particular polyethylene glycol of the chemical formula $HO—(CH_2—CH_2—O)_n—H$ with a mass-average molar mass of 90 to 800 g/mol or polypropylene glycol of the chemical formula $H[OCH(CH_3)CH_2]_nOH$ with a mass-average molar mass of 130 to 800 g/mol, or a compound comprising a furan ring, or a cyclic carbonate ester, in particular propylene or ethylene carbonate, alone or as a mixture, preferably alone.

In one preferred embodiment, the extraction solvent is chosen from propylene carbonate, ethylene carbonate and polyethylene glycol of the chemical formula $HO—(CH_2—CH_2—O)_n—H$ with a mass-average molar mass of from 90 to 800 g/mol, alone or as a mixture, preferably alone.

In one preferred embodiment, the extraction solvent is water with an acidic, basic or neutral pH.

Liquid-liquid Extraction

The pyrolysis oil and the extraction solvent can be contacted by any means known in prior art.

For example, the pyrolysis oil and the extraction solvent can be introduced into vessels, reactors or mixers commonly used in the art and the two components can be mixed. The contacting may involve vigorous agitation of the two components by a mixing device. For example, the two components may be mixed together by agitation or shaking. Alternatively, contacting may be carried out in a vessel in which the pyrolysis oil and extraction solvent are countercurrent circulated.

The two components may be contacted more than once. For example, after the pyrolysis oil and the extraction solvent have been contacted for the first time, the two resulting phases may be contacted again, possibly several times. The steps of contacting and forming the two phases can be continuous. Thus, the two components may pass through a mixing device before entering a separation chamber in which a first and second phase, namely a raffinate and an extract, are formed. The two components can be contacted by means of a propeller, a counter-current stream circulation device, an agitation device, a Scheibel® column, a KARR® column, a centrifugal extractor or a mixer-settler, in particular a two- or three-stage mixer-settler.

The pyrolysis oil can be contacted several times with new batches of extraction solvent, in particular one and a single extraction solvent.

Thus, in one preferred embodiment, the method may comprise:

a second contacting step in which the recovered raffinate is contacted with a new batch of the same extraction solvent as that used in the first contacting step mentioned, followed by a second step of recovering a second extract and a second raffinate which are immiscible with each other, optionally, these two steps are reiterated n times on the raffinate recovered during the recovery step of the previous iteration, where n is a non-zero integer. A purified pyrolysis oil, which can subsequently be subjected to a steam-cracking method (alone or as a mixture) is then formed by the raffinate from the last iteration carried out.

Hereafter, the term "raffinate" refers generally to the raffinate recovered during the recovery step when the method comprises a single contacting and recovery step, or the raffinate recovered during the second recovery step or the raffinate recovered during the last iteration of the contacting and recovery steps.

For example, the pyrolysis oil may be contacted with a first batch of extraction solvent to obtain a first raffinate and a first extract. After separating the raffinate from the extract, this first raffinate can be contacted with a second batch of extraction solvent to obtain a second raffinate and a second extract. This cycle can be reiterated several times with new batches of the same extraction solvent or with batches of different extraction solvents, but preferably with batches of one and the same solvent, which facilitates the implementation of the method and the recovery of the raffinates.

In one embodiment, the cycle of contacting the pyrolysis oil and its raffinate with an extraction solvent can be carried out from 1 to 9 times, in particular from 1 to 4 times. When this cycle is reiterated from 2 to 9 times, a same extraction solvent or different extraction solvents may be used for each cycle, but preferably one and the same solvent.

Typically, the pyrolysis oil and the extraction solvent are contacted to an extent that allows efficient extraction of the pyrolysis oil by the extraction solvent. As the pyrolysis oil and the extraction solvent are immiscible with each other, it will be understood by those skilled in the art that these solutions are generally intimately mixed until an emulsion is formed, which is then allowed to separate into two phases.

In particular, the pyrolysis oil can be contacted with the solvent for a period ranging from a few seconds to 1 hour.

This contacting can be carried out at a temperature of from 0 to 60° C., preferably from 0° to 40° C., more preferably from 0° to 30° C., in particular without external heating.

This contacting is typically carried out at atmospheric pressure.

The volume ratio of extraction solvent to pyrolysis oil may be from 0.05:1 to 5:1, preferably from 0.5:1 to 2:1, for example 1:1, or within an interval defined by the combination of the aforementioned values.

The recovery of the two immiscible phases, namely the extract and the raffinate, can be performed in the usual way, by separation, generally by a physical separation process. This separation generally consists in physically isolating the raffinate, or at least one part of it. This separation generally consists in separating at least one part of the raffinate from the extract.

Because of their immiscibility, the two phases (raffinate and extract) are generally separated in the contacting enclosure or may be separated in another enclosure. This separation may simply consist in removing (for example by withdrawal or decanting) at least one part of the extract or raffinate.

In particular, the method according to the invention can make it possible to obtain a reduction rate of the heteroatoms contained in the polar compounds of from 30 to 99%, in particular greater than 40%, this reduction rate being defined, for each element, by equation 1:

$$\text{Reduction rate} = 100 \cdot \frac{(X_H - X_R)}{X_H} \quad \text{[Equation 1]}$$

where:

$X_H$ is the content in mg/kg of the element in the pyrolysis oil before treatment, $X_R$ is the content in mg/kg of the element in the raffinate.

The method according to the invention can thus make it possible to obtain one or several of the following reduction rates:

- from 20 to 99% or from 30 to 99% for oxygen,
- from 40 to 99% or from 50 to 99% for nitrogen,
- from 40 to 99%, in particular from 50 to 99%, for sulphur,
- from 10 to 95% or from 40 to 95% for halogens, in particular chlorine, bromine and fluorine,
- from 10 to 99% for metals, especially transition metals, in particular iron.

The oxygen content can be measured in accordance with ASTM D5622/D2504.

Nitrogen content can be measured in accordance with ASTM D4629.

Sulphur content can be measured in accordance with ISO 20846.

Halogen content may be measured in accordance with ASTM D7359.

Alkali metal content can be measured in accordance with ASTM D5708 A or IP 501.

Alkaline earth metal content can be measured in accordance with ASTM D5708 A or IP 501.

Transition metal content can be measured in accordance with ASTM D5708 A or IP 501, Where not specified, the versions of the standards cited in this patent application are those in force on 29 Jan. 2021.

Advantageously, the raffinate according to the invention may have at least one of the following characteristics:

- an oxygen content less than or equal to 100 mg/kg,
- a nitrogen content less than or equal to 75 mg/kg,
- a sulphur content of at most 700 ppm (by mass),
- a content of alkali metals, in particular K and Na, of less than or equal to 4 mg/kg,
- a halogen content of less than or equal to 15 mg/kg, in particular a chlorine content of less than or equal to 1 ppm (by mass),
- a total metal content of at most 2 mg/kg.

The raffinate according to the invention can be subjected to a steam-cracking treatment, optionally after one or several post-treatments—typically chosen from a hydrogenation treatment, cracking and hydrocracking—alone or in mixture with other steam cracker feedstocks. In other words, the raffinate can be treated in a steam cracker in a pure or diluted form, optionally after the aforementioned post-treatment. Preferably, the post-treatment(s) do not comprise a separation of the extraction solvent from the raffinate.

In particular, the raffinate according to the invention may exhibit, after one or more of the aforementioned post-treatments and/or dilution with a typical steam cracker feedstock, at least one of the typical characteristics of a steam cracker feedstock, in combination with one or more of the characteristics set forth above.

A typical steam cracker feedstock has the following characteristics:

- an oxygenate content of less than or equal to 50 ppm (by mass),
- an olefin content of less than or equal to 1% vol,
- a paraffin content greater than or equal to 65% vol,
- an aromatic hydrocarbon content as low as possible in order to limit the coke formation during subsequent treatment of the raffinate.

The aromatic hydrocarbon content can be determined in accordance with ISO 22854.

For example, the specifications for a steam cracker feedstock are defined in the following documents

- AIChE paper number 36d, Feedstock Contaminants in Ethylene Plants—2017 Update,
- Open spec naphtha (OSN) CFR FAR EAST OPEN SPECIFICATION FORM NAPHTHA AGREEMENT, 2017 EDITION.

The steam-cracking method can be carried out in the usual way, in particular at temperatures of from 650° to 1000° C., typically from 700 to 900° C. or from 750 to 850° C. The heated feedstock is introduced into a cracking zone where it undergoes steam-cracking under conditions suitable for producing at least olefins and hydrogen. Steam is introduced into the cracking zone to reduce the partial pressure of hydrocarbons and promote the production of olefins. The steam also reduces the formation and deposition of carbon material, particularly coke, in the cracking zone. Cracking occurs in the absence of oxygen. The residence time in the cracking zone is very short, typically a few milliseconds.

EXAMPLES

The feedstock used is a cut (37-406° C.) of plastic pyrolysis oil (PPO), the main characteristics of which are listed in Table 3.

TABLE 3

| pyrolysis oil | PPO |
|---|---|
| Density (kg/m$^3$) | 788.0 |
| Chlorine (ppm by mass) | 535 |
| Silicon (ppm by mass) | 27 |
| Nitrogen (mg/L) | 1530 |
| Sulphur (mg/L) | 64.7 |
| Oxygen (% by mass) | 0.54 |
| Aromatics (% by mass) | 7.0 |
| MAV (mg/g) | 15.8 |

Example 1: Miscibility Tests

Miscibility tests have been carried out with three solvents, polyethylene glycol with an average molar mass of 200 g/mol (PEG-200), polypropylene carbonate (PC) and N-formylmorpholine (NFM; CAS 4394-85-8), according to the protocol below:

- into a 100 mL flat-bottomed flask, introduce 50.0 mL of feedstock, using a precision pipette,
- introduce 2.0 mL of solvent, using a precision pipette,
- Introduce a bar magnet and closing the flask with a polypropylene stopper,
- Agitate the mixture on a magnetic agitation plate at a 500 rpm speed for 5 minutes.
- At the end of the 5 minutes, stop agitation and remove the bar magnet using a magnetised rod,
- Transfer the contents of the flask to a volumetric ASTM centrifuge tube. Waiting for complete demixing and measuring the volume of the 2 phases using the graduations.

The results are listed in Table 4.

TABLE 4

| Solvent | PEG-200 | PC | NEM |
|---|---|---|---|
| Test temperature | Ambient | Ambient | Ambient |
| Miscibility | No/2 phases | No/2 phases | No/2 phases |
| $V_{solvent}$ (mL) | 2.0 | 2.0 | 2.0 |
| $V_{PPO}$ (mL) | 50.0 | 50.0 | 50.0 |
| $V_{extract}$ (mL) | 2.0 | 2.4 | 1.8 |
| Recovery rate | 1.00 | 1.20 | 0.90 |

After contacting the 2 phases:

- 100 mass % of PEG 200.
- 120 mass % of the PC, which means that part of the feedstock has solubilised in the solvent.
- 90 mass % of the NFM. The remaining 10% is mixed with the feedstock.

Example 2: Liquid/liquid Extraction Tests

Liquid/liquid extraction tests have been carried out by contacting plastic pyrolysis oil (PPO) with each of the three solvents (PEG 200, PC, NFM).

The following protocol has been used:

- contact of the plastic pyrolysis oil (PPO) with the solvent at ambient temperature in a PPO/solvent volume ratio: 50/50;
- agitating at 500 rpm for 5 minutes to ensure proper contact between the two phases;
- separating the phases after resting for 30 minutes.

A raffinate corresponding to the PPO treated and an extract containing the solvent have been obtained. The mass raffinate/PPO and extract/solvent yields are all around 100%. No loss of product is observed. The compositions of the raffinates are listed in Table 5.

TABLE 5

| product | PPO | Raffinate 1 | Raffinate 2 | Raffinate 3 |
|---|---|---|---|---|
| Solvent used for extraction | | PEG 200 | PC | NFM |
| Chlorine (ppm by mass) | 535 | 173 | 133 | 113 |
| Chlorine reduction (%) | | 68 | 75 | 79 |
| Silicone (ppm by mass) | 27 | 24 | 22 | 25 |
| Silicone reduction (%) | | 11 | 18 | 7 |
| Nitrogen (mg/L) | 1530 | 287.4 | 281.9 | 1467 |
| Nitrogen reduction (%) | | 81 | 82 | 4 |
| Sulphur (mg/L) | 64.7 | 29.3 | 24.7 | 33 |
| Sulphur reduction (%) | | 55 | 62 | 49 |
| Oxygen (% by mass) | 0.57 | 0.22 | 0.31 | 0.44 |

TABLE 5-continued

| product | PPO | Raffinate 1 | Raffinate 2 | Raffinate 3 |
|---|---|---|---|---|
| oxygen reduction (%) | | 61 | 46 | 19 |
| MAV (mg/g) | 15.8 | 12.4 | 12.8 | 11.2 |
| MAV reduction (%) | | 22 | 19 | 29 |

PEG 200 and PC have a solvent recovery rate after liquid/liquid extraction of over 95%. Liquid/liquid extraction with PEG 200 enables 55% of the sulphur, 70% of the chlorine, 80% of the nitrogen and 60% of the oxygen contained in a plastic pyrolysis oil to be extracted.

NFM has a solvent recovery rate of less than 95% after liquid/liquid extraction. Although chlorinated and sulphurous species are reduced in proportions comparable to those observed with PEG 200 and PC, the results show lower oxygen and nitrogen reduction capabilities.

Example 3: Liquid/liquid Extraction Test in Water

A liquid/liquid extraction test has been carried out by contacting a PPOB pyrolysis oil with a density of 799.1 kg/m3 with water at neutral pH. This PPOB oil is originating from the pyrolysis of a feedstock containing 10 to 15% biomass by mass, the rest of the feedstock being made up of plastics.

The following protocol has been used:

- Contacting the pyrolysis oil (PPOB) with water at ambient temperature in a PPOB/water volume ratio of 50/50;
- agitating at 500 rpm for 5 minutes to ensure proper contact between the two phases;
- separating the phases after resting for 30 minutes.

The compositions of the PPOB and raffinate are listed in Table 6.

Extraction enables the chlorine, nitrogen and oxygen content to be markedly reduced.

TABLE 6

| product | PPOB | Raffinate |
|---|---|---|
| Chlorine (ppm by mass) | 517 | 440 |
| Chlorine reduction (%) | | 15 |
| Nitrogen (mg/L) | 1775 | 961.2 |
| Nitrogen reduction (%) | | 46 |
| Oxygen (% by mass) | 1.55 | 1.21 |
| Oxygen reduction (%) | | 22 |

The invention claimed is:

1. A method for purifying a pyrolysis oil originating from the pyrolysis of waste containing plastics, comprising:

- providing a pyrolysis oil containing saturated and unsaturated hydrocarbon compounds and polar compounds comprising at least one heteroatom selected from the group consisting of oxygen, sulphur, nitrogen, a transition metal, an alkali metal, an alkaline-earth metal and a halogen, the pyrolysis oil provided being a liquid organic phase or a mixture of liquid organic phases resulting from the pyrolysis of plastic waste and at least one other waste which comprises biomass, optionally in mixture with another waste which is an elastomer,
- contacting the pyrolysis oil with a polar extraction solvent immiscible with the pyrolysis oil,
- recovering an extract and a raffinate which are immiscible with each other, the extract containing the extraction solvent and at least one part of the polar compounds, and optionally at least one part of the unsaturated hydrocarbon compounds, initially contained in the pyrolysis oil, the raffinate containing a treated pyrolysis oil with a reduced content of polar compounds and optionally of unsaturated hydrocarbon compounds, wherein the polar extraction solvent immiscible with the pyrolysis oil is selected from the group consisting of water having an acidic, basic or neutral pH, glycol ethers, dialkyl formamides in which the alkyl group comprises from 1 to 8 carbon atoms, dialkyl sulphoxides in which the alkyl group comprises from 1 to 8 carbon atoms, compounds comprising a furan ring, cyclic carbonate esters comprising from 3 to 8 carbon atoms, and mixtures thereof, and is a solvent for which a recovery rate greater than or equal to 0.95 is obtained, this recovery rate being defined as the ratio of the volume of an extract to a volume of initial solvent, and this extract is a phase containing the solvent, immiscible with the pyrolysis oil, recovered after agitation and then decanting a mixture of one part by volume of solvent with twenty-five parts by volume of the pyrolysis oil at atmospheric pressure and at a temperature of 20° C.

2. The purification method according to claim 1, wherein the pyrolysis oil provided is a liquid organic phase resulting from the pyrolysis of waste comprising from 50 mass % to 99 mass % of plastics.

3. The purification method according to claim 2, wherein the pyrolysis oil provided is a liquid organic phase resulting from the pyrolysis of waste comprising from 1 to 50 m/m % of at least one other waste which comprises a biomass.

4. The purification method according to claim 1, wherein the pyrolysis oil provided is a mixture of at least two liquid organic phases resulting from the pyrolysis of waste and comprises from 50 m % to 99 m % of at least one liquid organic phase resulting from the pyrolysis of plastics.

5. The purification method according to claim 4, wherein the pyrolysis oil provided is a mixture of at least one organic phase resulting from the pyrolysis of plastics and at least one organic phase resulting from the pyrolysis of at least one other waste which comprises a biomass, and comprises from 1 to 50 m/m % of, of an organic phase resulting from the pyrolysis of said at least one other waste material.

6. The purification method according to claim 1, wherein the polar extraction solvent is selected from the group consisting of propylene carbonate, ethylene carbonate, polyethylene glycol of the chemical formula $HO—(CH_2—CH_2—O)_n—H$ with a mass-average molar mass of from 90 to 800 g/mol, polypropylene glycol of the chemical formula $H\ [OCH\ (CH_3)\ CH_2]_nOH$ with a mass-average molar mass of 130 to 800 g/mol and mixtures thereof.

7. The purification method according to claim 1, further comprising:

a second contacting step in which the raffinate recovered is contacted with a new batch of the same extraction solvent as that used in the first contacting step mentioned, followed by a second step of recovering a second extract and a second raffinate which are immiscible with each other, optionally, these two steps are reiterated n times on the raffinate recovered during the recovery step of the previous iteration, where n is a non-zero integer.

8. A steam-cracking method comprising a step of steam-cracking a pyrolysis oil raffinate recovered upon implementing the method according to claim 1.

9. The purification method according to claim 3, wherein the at least one other waste material comprises a biomass and an elastomer.

10. The purification method according to claim 3, wherein the biomass is selected from the group consisting of lignocellulosic biomass, paper and cardboard.

11. The purification method according to claim 5, wherein the at least one other waste material comprises a biomass and an elastomer.

12. The purification method according to claim 5, wherein the biomass is selected from the group consisting of lignocellulosic biomass, paper and cardboard.

13. The purification method according to claim 1, wherein the polar extraction solvent immiscible with the pyrolysis oil is selected from the group consisting of glycol ethers.

14. The purification method according to claim 13, wherein the glycol ether is selected from the group consisting of polyethylene glycol of the chemical formula $HO—(CH_2—CH_2—O)_n—H$ with a mass-average molar mass of from 90 to 800 g/mol, polypropylene glycol of the chemical formula $H\ [OCH\ (CH_3)\ CH_2]_nOH$ with a mass-average molar mass of 130 to 800 g/mol and mixtures thereof.

* * * * *